United States Patent [19]

Thiel

[11] Patent Number: 4,993,202

[45] Date of Patent: Feb. 19, 1991

[54] CAVITY FLOOR

[75] Inventor: Dieter Thiel, Siegburg, Fed. Rep. of Germany

[73] Assignee: Schmidt Reuter Ingenieurgesellschaft mbH & Co. K.G., Fed. Rep. of Germany

[21] Appl. No.: 327,913

[22] PCT Filed: Jul. 29, 1987

[86] PCT No.: PCT/EP87/00413

§ 371 Date: Jan. 27, 1989

§ 102(e) Date: Jan. 27, 1989

[87] PCT Pub. No.: WO88/00997

PCT Pub. Date: Feb. 11, 1988

[30] Foreign Application Priority Data

Jul. 31, 1986 [DE] Fed. Rep. of Germany ... 3620530[U]
Nov. 7, 1986 [DE] Fed. Rep. of Germany ... 8637987[U]

[51] Int. Cl.[5] ..... E04C 2/32

[52] U.S. Cl. ..... 52/220; 52/630; 52/792; 428/197; 428/180

[58] Field of Search ..... 52/792, 630, 221, 220; 428/197, 180

[56] References Cited

U.S. PATENT DOCUMENTS

| | | | |
|---|---|---|---|
| 3,461,632 | 8/1969 | Kahne | 52/792 |
| 3,572,664 | 9/1970 | Hale | 52/792 |
| 3,706,627 | 12/1972 | Arne | 428/180 |
| 4,348,442 | 9/1982 | Figge | 428/180 |

FOREIGN PATENT DOCUMENTS

| | | | |
|---|---|---|---|
| 750096 | 1/1967 | Canada | 52/792 |
| 709279 | 5/1954 | United Kingdom | 428/180 |

*Primary Examiner*—Henry E. Raduazo
*Attorney, Agent, or Firm*—Spensley Horn Jubas & Lubitz

[57] ABSTRACT

A cavity floor that includes a profiled sheet material. The sheet material has support feet that are substantially rigid. The surface of the sheet material extending between the support feet is substantially flexible. The thickness of the sheet material and the mutual spacing of the support feet are selected so that the sheet material is sufficiently rigid to support a person and sufficiently flexible to adapt to an uneven floor surface. The deformable surface enables automatic vertical adjustment of the support feet relative to one another when under load.

18 Claims, 2 Drawing Sheets

CAVITY FLOOR

BACKGROUND OF THE INVENTION

1. Field of the Invention

The invention relates to a cavity floor.

2. Description of Related Art

Cavity floors are known that have a profiled floor foil, having support feet, which is put on the underlying floor or on an insulation layer, for forming a mould for the lime floor to be spread thereon, to constitute the floor surface (EP-A-0 057 372). Beneath the floor sheet, a cavity, which can be used for embedding cables, tubes and the like and as a hot air space of a floor heating is formed around the support feet. The known floor sheet consists of flexible soft plastic material that is not capable of carrying a person walking thereon. The lime floor is spread as liquid cast plaster and is distributed evenly. -The support feet adapt to eventual unevennesses of the underlying floor. The disadvantage of said floor sheet is that, due to its low load capacity, it is not capable of carrying a person walking thereon and, thus, it does not allow manual smoothing of the liquid lime floor material.

Furthermore, floor slabs are known that consist of thick-walled rigid material, having a high load capacity and stability, thus being capable of carrying a person walking thereon, but not allowing an automatic adaptation to eventual unevennesses of the underlying floor. Moreover, the high consumption of material and the high dead weight of the rigid formed slabs are disadvantageous. The cutting of the formed slabs is difficult (GB-A-996 807).

The support sheet of another known cavity floor (WO-A-8602120) consists of square fields that taper in the support feet, yet which keep a square structure in the support feet. The fields extend at right angles and in parallel to each other, so that a pattern of ridges crossing at right angles remains between the fields. Each of the support feet forms a lower truncated pyramid and an adjoining upper truncated pyramid with different top angles. Both truncated pyramids are separated from each other by a vertical kink line. The upper truncated pyramids are provided with outwardly bulging ribs. The support sheet of the known cavity floor is stiffened only insofar as to withstand the weight of the lime floor. The only function of the ribs is to stiffen the wide-throated upper truncated pyramid, so that it has approximately the same load capacity as the non stiffened lower truncated pyramid. Such a support sheet, less than 1 mm thick, had no load capacity that allows a reason to walk upon the sheet before the lime floor has been filled in.

It is an object of the invention to provide a cavity floor having a sheet that can be walked upon prior to the spreading of the lime floor and yet adapts to eventual unevennesses of the underlying floor and can be filled with lime floor of a pulpy consistence.

SUMMARY OF THE INVENTION

Between the support feet, the horizontal areas of the floor sheet of the cavity floor according to the invention are soft and flexible, whereas the support feet themselves are stiffened to such a degree by the thickness of the material on the one hand, and by their profiling on the other hand that they have a high load capacity. Thus, the floor sheet is resilient in the deformation areas, whereas the support feet are stiffened by ribs so that they can be termed rigid both in the vertical direction and with regard to lateral forces. Immediately adjacent to the rigid support feet is the horizontal deformation area, so that the sheet can easily warp within the whole space between two support feet and adapt to the local conditions. The support feet of the floor sheet form rigid blocks, while the upper deformation area is flexible. The support feet are of such shape and size that a foot of a person cannot sink into them, i.e. the diameter of their inner circle at the open end should be less than 75 mm. Moreover, the support feet, due to their shape, the form of the ribs and the steepness of their lateral surfaces, have such a high inner stiffness that deformations cannot occur, neither by the weight of a person nor by lateral indentation.

A high form stability of the support feet can be achieved by providing the edge at the open end of a support foot with straight parts not longer than 20 mm and, preferably, with no straight parts at all. At the upper and the lower ends of the support feet, this results in only short or no straight lines at all, but arcuate kink lines in those areas, where the lateral surface passes into the deformation area. Forces are transmitted from the horizontal upper part of the floor sheet to the lateral surfaces and the ribs via arcuate kink lines, without causing deformations. Also at the lower end of the ribs only short and straight horizontal buckle lines result at the most.

The floor sheet has a low dead weight; it can easily be cut, because of the large surface area of the horizontal deformation areas and it allows a fast and simple lay and adaptation to the layout of a building.

A particular advantage is that the floor sheet can be walked upon without a load distributing cover.

The wall thickness of the support feet is at least about 1 mm and about 2 mm at the most, preferably about 1.2 mm at the most. The wall thickness is dimensioned, on the one hand, to provide the floor sheet with a high vertical load capacity at the support feet, taking into consideration the sheet's stiffening shape, yet, on the other hand, it is thin enough to allow adjacent foil slabs or strips to overlap at the edges without causing steps in the lime floor layer.

The edges of sheet slabs or strips may be overlapped loosely, without requiring cementing or sealing. The lime floor, spread in a pulpy state, does not enter in between the loosely overlapping edges. Due to the comparatively thin wall thickness of the sheet material, the support feet can be fitted into each other in the overlapping areas, without any substantial difference in height of the upper part of the sheet-type mould.

Another advantage of the thin wall thickness of the sheet material is the low thermal conduction resistance of the floor surface, if the floor cavity is used for the distribution of hot air, so that the heat of the hot air is transmitted well to the floor surface, from which it is dissipated or diverted.

Thus, foil's wall thickness should be as thin as possible. The lower limit of said wall thickness is determined by its mechanical resistance and load capacity.

According to a preferred embodiment of the invention, the ribs form inwardly extending channels. Said channels increase the section modulus and the rigidity of the support feet; they reduce the volume of the support feet, thus also reducing the amount of lime floor to be filled in; in case the cavities should be used for the distribution of hot air, they cause swirls and increase the surface to achieve an improved heat transmission between the hot air and the lime floor.

Preferably, the support feet are provided with at least five ribs, distributed over their periphery.

The floor sheet according to the invention is preferably delivered in slabs, always being a sheet of a defined width and limited length.

With reference to the drawings, the following is a detailed description of embodiments of the invention.

In the figures

DESCRIPTION OF THE PREFERRED EMBODIMENT

Figure 1:
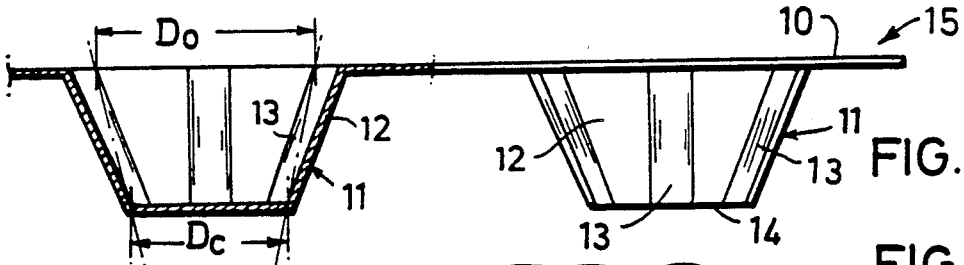
FIG. 1 is a side view of the floor sheet, partly cut.
Figure 2:
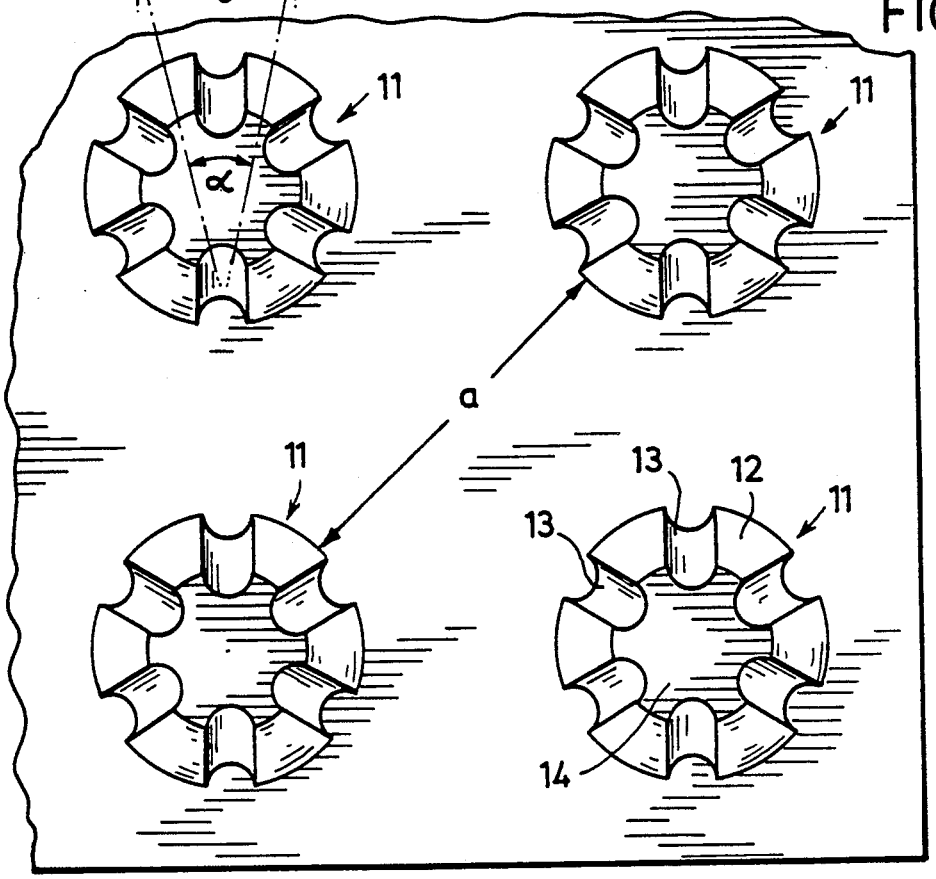
FIG. 2 is a view of the floor sheet from below.

The floor sheet according to FIGS. 1 and 2 consists of plastic material of even thickness, of at least 1 mm and 2 mm at the most, preferably amounting to 1.2 mm at the most. The sheet comprises a web- or slab-shaped even area 10 from which support feet 11 extend, formed by deep-drawing. The support feet 11 generally have a truncated cone shape and a circular horizontal cross-section, with the truncated cone-shaped lateral surface 12 being provided with inwardly extending channel-shaped ribs 13 of a round shape and a semi-circular cross-section. With a constant cross-section, the support feet extend from the horizontal area 10 to the bottom surface 14. In the outer surface of a support foot 11, the ribs 13 form vertical channels that extend radially to the upper end of a support foot 11 (view from below, according to FIG. 2). The upper part of the ends of the inwardly extending ribs 13 are filled with the material of the area 10 and are open at their lower ends, so that the bottom surface 14 has a gear wheel-like shape. The embodiment has 6 ribs 13 arranged at regular distances around the periphery of a support foot 11.

The diameter of the peripheral circle of a support foot 11 at the lower closed front wall of the support foot is defined as $D_c$. Said peripheral circle is defined as the circle encompassing all contours of the front wall. The diameter of the inner circle at the open end of a support foot is called $D_o$. The circles with the diameters $D_c$ and $D_o$ lie on a conic lateral surface, the top angle "$\alpha$" of which is comparatively small and amounts to 50° at the most, preferably to 40° at the most.

As can be seen in FIG. 2, the support feet 11 are arranged at the intersections of a web of lines crossing each other at right angles, so that they form longitudinal and transverse rows.

At no point is the distance a between the two open ends of adjoining support feet larger than 75 mm. Adjacent each support foot are both those support feet which lie within the same rectangular row of the pattern of support feet as the respective support foot and those support feet that are in a diagonal row with the support foot concerned. The distance a is related to two adjacent support feet of a diagonal row. Said distance at least equals the diameter $D_o$ of the inner circle at the open end of the support foot, so that the deformation areas 10 have a surface sufficient enough to allow deformations of said deformation areas for height adaptation of the support feet to an uneven ground. Yet, the distance a must not be larger than 75 mm, since a person walking on the floor sheet could be in danger of sinking in between two support feet. The width of a grown-up's shoe heel is about 80 mm. Such a heel cannot sink into a support foot 11.

Figure 3:
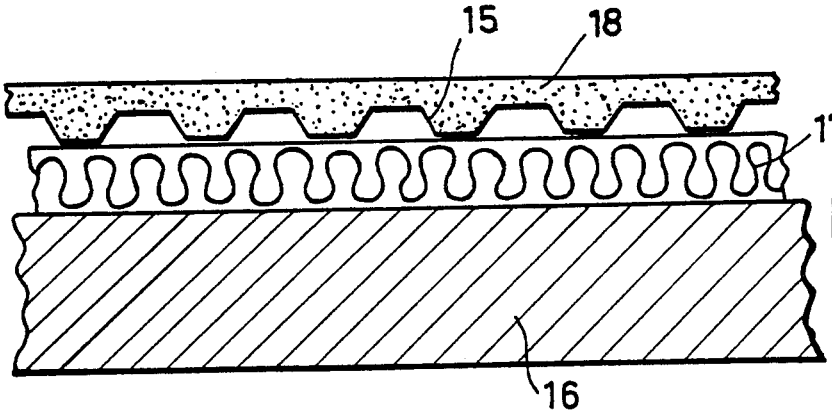
FIG. 3 is a cross section of an embodiment of a cavity floor, made with the use of the floor sheet.

FIG. 3 shows a cavity floor with a heat insulating layer 17 arranged on the underlying ground 16, e.g. a raw concrete ceiling, on which the floor sheet 15 of FIGS. 1 and 2 stands, support feet down. The lime floor 18 which will constitute the floor surface has been spread on the floor sheet 15. Said lime floor fills the support feet 11 completely and develops an additional continuous layer on top of the horizontal area 10. To spread the lime floor 18, the floor sheet 15, previously laid loosely on the insulation layer 17, is capable of bearing the weight of a walking person without auxiliary load distributing means.

The floor sheet can also be used in the opposite way, i.e. with the support feet up. Nor is it necessary to use the floor sheet as a mould for lime floor material. The floor sheet can be used as a supporting element of a cavity floor, with a load distributing layer being provided over it.

Deviating from the above mentioned embodiment, the support feet 11 can also be stiffened by outwardly extending ribs. This, however, results in a higher consumption of lime floor material and a lower load capacity.

Figure 4:
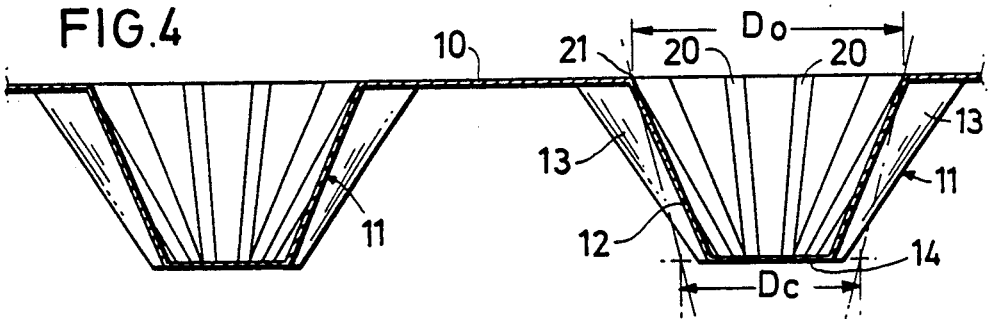
FIG. 4 is a vertical section of a second embodiment of the floor sheet, along line IV—IV in FIG. 5.
Figure 5:
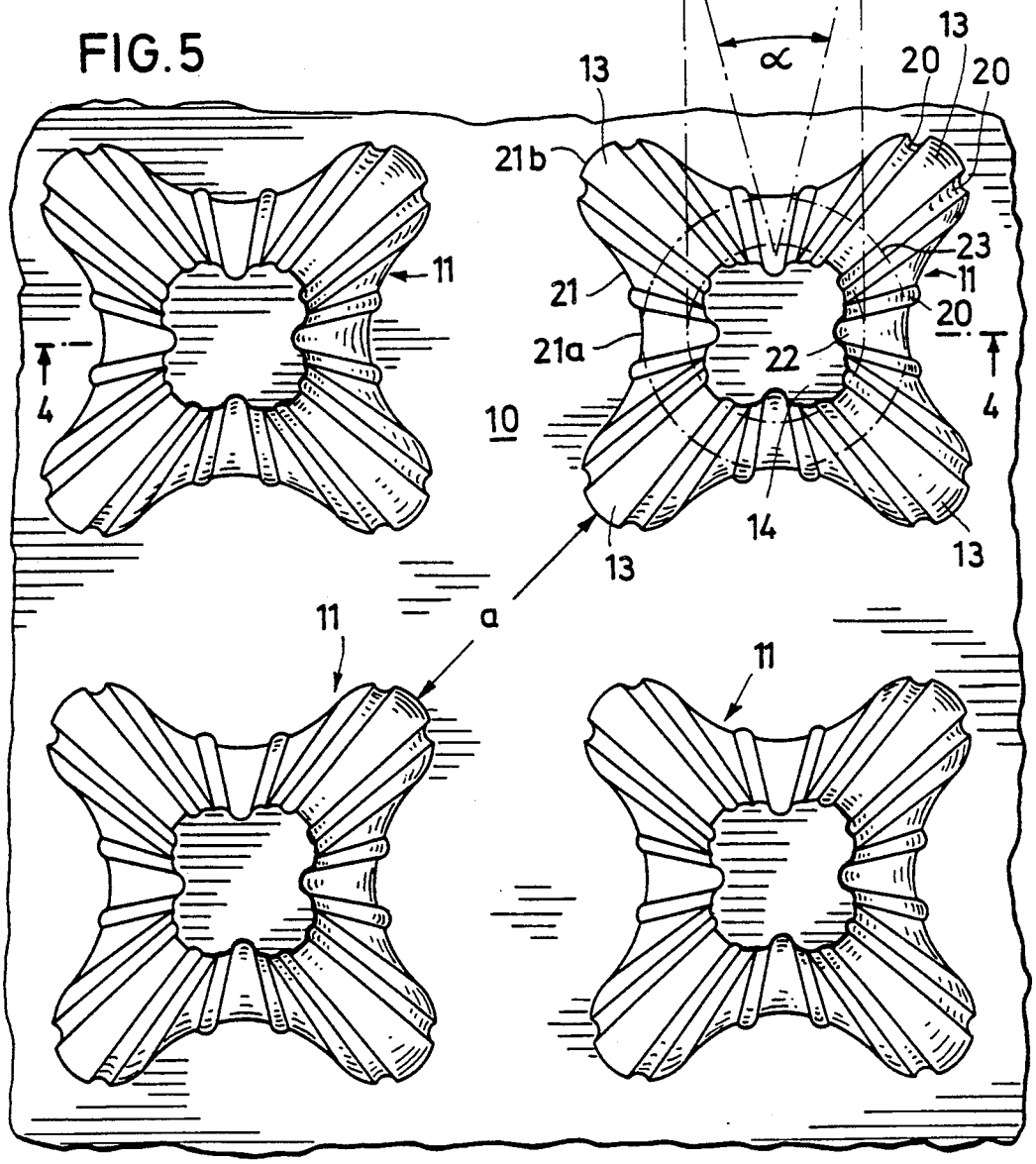
FIG. 5 is a top view of the floor sheet in FIG. 4.

FIGS. 4 and 5 show a floor sheet with differently shaped support feet 11. In this case, each support reinforced by narrower ribs 20, which are outwardly directed, too. Each support foot 11 is provided with four radial ribs 13, arranged crosswise and extending over the whole height of the support foot. The radial width of the ribs 13 increases from the front wall 14 towards the open end. In the space between two support feet 11—with regard to the middle axis of a support foot—the horizontal kink line 21 at which the lateral surface 12 of the support foot passes into the horizontal area 10 is provided with an arcuate concave area 21*a* and an arcuate convex area 21*b* at the support feet 11. The arcuate areas 21*a* and 21*b* smoothly pass into each other.

Since the horizontal kink line 21 has no straight parts, the ability to transfer load from the area 10 to a support foot 11 is improved and the tilt resistance of the support feet is increased.

The peripheral circle 22 at the end surface 14 of a support foot has the diameter $D_c$ and the inner circle 23 at the open end of a support foot has the diameter $D_o$. The imaginary circles 22 and 23 lie on a (imaginary) conic lateral surface, having a top angle "$\alpha$".

In FIGS. 4 and 5, too, the maximum distance of adjacent support feet does not exceed 75 mm and is at no point smaller than the diameter $D_c$ of the peripheral circle 22 of the end surface 14. This area 10, yet allows the flat area 10 to function as the deformation area.

What is claimed is:

1. A cavity floor comprising:

a profiled foil having a thickness and comprising a sheet material provided with formed out parts defining substantially rigid portions and substantially flexible portions, the substantially rigid portions forming support feet that are arranged at mutual distances and the substantially flexible portions defining horizontal upper areas between the support feet, each support foot having a height, an end surface defining a peripheral circle and an open end defining an inner circle, said horizontal upper areas constituting deformation areas for automatic vertical adjustment of the support feet relative to one another when under load and said support feet comprising ribs that extend up to the deformation areas, and a lime floor layer that covers the support feet and provides a flat floor surface over the foil, characterized in that said support feet are provided with a lateral surface having a height and being free of horizontal kink lines;

the ribs extend over the whole height of the lateral surface; the thickness of the foil and the mutual distances for the support feet being selected so that the foil is sufficiently rigid to support a person standing on the foil and sufficiently flexible to adapt to an uneven floor surface and the peripheral circle at the end surface of each support foot and the inner circle at the open end of said support foot both lie on a conical lateral surface with a maximum top angle of 50°.

2. The cavity floor according to claim 1, characterised in that the thickness of the foil is at least 1.2 mm.

3. The cavity floor according to claim 1, characterised in that the ribs form inwardly directed channels.

4. The cavity floor according to claim 1, characterised in that the ribs have a round cross-section.

5. The cavity floor according to claim 1, characterised in that the ribs have a constant cross-section along the height of the support feet.

6. The cavity floor according to claim 1, characterised in that the conical lateral surface has a top angle of approximately 25°.

7. The cavity floor according to claim 1, characterised in that defines an edge having no straight parts longer than 20 mm.

8. The cavity floor according to claim 1, characterised in that the open ends of adjacent support feet are spaced apart by a distance no greater than 75 mm.

9. The cavity floor according to claim 1, characterised in that the inner circle at the open end of a support foot defines a diameter smaller than 75 mm.

10. A cavity floor comprising:

a profiled sheet material having a thickness and defining substantially rigid portions and substantially flexible portions, the substantially rigid portions including a plurality of mutually spaced support feet and the substantially flexible portions including a resilient deformable surface extending between the support feet, at least one of the support feet having a bottom end defining a peripheral circle, a top end substantially adjacent the deformable surface and defining an inner circle, and a lateral surface substantially extending from the bottom end to the top end, a plurality of ribs substantially extending along the lateral surface from the bottom end to the top end, the peripheral circle and the inner circle mutually defining a conical lateral surface having a maximum angle of approximately 50°, the thickness of the sheet material and the mutual spacing of the support feet being selected so that the sheet material is sufficiently rigid to support a person standing on the sheet material and sufficiently flexible to adapt to an uneven floor surface, whereby the support feet are capable of bearing a walking person and the deformable surface enables automatic vertical adjustment of the support feet relative to one another when under load.

11. The cavity floor according to claim 10 wherein the thickness of the sheet material is at least 1.2 mm.

12. The cavity floor according to claim 10 wherein the ribs form inwardly directed channels.

13. The cavity floor according to claim 10 wherein the ribs have a curved cross-section.

14. The cavity floor according to claim 10 wherein the ribs have a substantially constant cross-section.

15. The cavity floor according to claim 10, wherein the conical lateral surface has maximum angle of approximately 25°.

16. The cavity floor according to claim 10, wherein the top end of the support foot defines an edge having straight segments not greater than 20 mm in length.

17. The cavity floor according to claim 10, wherein the distance between the top ends of adjacent support feet is not greater than 75 mm.

18. The cavity floor according to claim 10, wherein the diameter of the inner circle is not greater than 75 mm.

* * * * *